US005149588A

United States Patent [19]

Fukushima et al.

[11] Patent Number: 5,149,588

[45] Date of Patent: Sep. 22, 1992

[54] FITTING PAD FOR SKI BOOTS

[75] Inventors: Toshiharu Fukushima; Takashi Okada, both of Hamamatsu, Japan

[73] Assignee: Yamaha Corporation, Japan

[21] Appl. No.: 402,781

[22] Filed: Sep. 5, 1989

[30] Foreign Application Priority Data

Sep. 7, 1988 [JP] Japan ..... 63-224274
Sep. 7, 1988 [JP] Japan ..... 63-224275

[51] Int. Cl.[5] ..... B32B 9/04

[52] U.S. Cl. ..... 428/411.1; 428/522; 36/117; 36/118; 36/119; 36/88; 36/93; 219/211; 524/314; 524/561

[58] Field of Search ..... 36/117-121, 36/88, 93, 71, 2.6; 523/109; 524/314, 561; 219/211; 428/522, 411.1

[56] References Cited

U.S. PATENT DOCUMENTS 3,529,368 9/1970 Canfield ..... 36/71
3,892,692 7/1975 Heiberger ..... 524/314
3,925,916 12/1975 Garbuio ..... 36/71
4,019,266 4/1977 Hanson et al. ..... 36/71
4,041,002 8/1977 Aboshi et al. ..... 524/314
4,234,660 11/1980 McKenna, Jr. ..... 428/522
4,243,754 1/1981 Swan, Jr. ..... 36/71
4,255,202 3/1981 Swan, Jr. ..... 36/117
4,418,117 11/1983 Shaw ..... 428/522
4,534,122 8/1985 MacPhail ..... 36/88
4,782,602 11/1988 Lakic ..... 219/211

*Primary Examiner*—Ellis P. Robinson
*Assistant Examiner*—Nasser Ahmad
*Attorney, Agent, or Firm*—Lerner, David, Littenberg, Krumholz & Mentlik

[57] ABSTRACT

In composition of a copolymer making up a fitting pad for ski boots containing, as the major component, vinyl acetate, an acrylic component and ethylene, the content ratio of components other than ethylene is 20% or larger and the average molecular weight is 30,000 or smaller. The specified content ratio of the component other than ethylene and average molecular weight results in good fitness to a skier's foot thanks to good fluidization of the fitting material during application process, thereby assuring painless use even for a long period and good transmission of the movement of the skier's leg to the ski.

14 Claims, 3 Drawing Sheets

Fig. 1
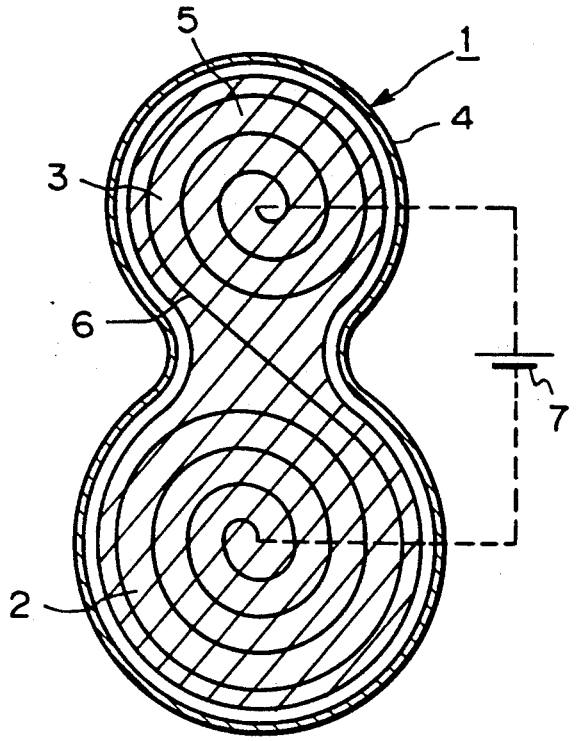
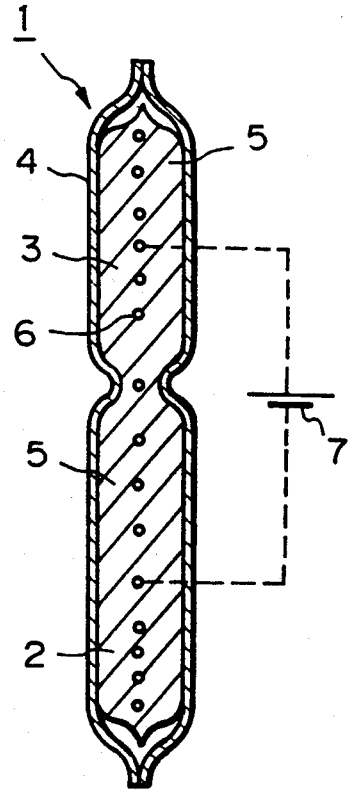
Fig. 2

FITTING PAD FOR SKI BOOTS

BACKGROUND OF THE INVENTION

The present invention relates to a fitting pad for ski boots, and more particularly relates to a fitting pad to be inserted between a skier's foot and a hard shell of a ski boot for painless protection of the foot within the shell.

A shell of a ski boot is made into a relatively hard construction for direct transmission of the movement of the skier's leg to the ski. The size and shape of the foot to be accommodated within the shell differ from skier to skier. For painless, stable holding of a foot within the hard shell of a standardized size and shape regardless of such personal difference in foot size and shape, it is generally employed to place a fitting pad between the foot and the hard shell.

Gum and soft foam urethane have been used for the conventional fitting pad of this kind.

A gum pad is made easily deformable when heated by body temperature of the foot accommodated therein. For such a gum fitting pad is generally used a mixture of low melting point parafin wax with silica, a mixture of natural rubber with cork, a mixture of isobutylene-isoprene copolymer with paper fibers and talc or a mixture of foam styrole with zinc stearate. In use such a gum fitting pad is inserted into the inner boot of a ski boot.

The soft foam urethane fitting pad is formed by mixing two kinds of reactive solutions so that the resultant foaming pressure should inject the pad material into a space between a foot and a shell for subsequent hardening.

As stated above, the gum pad material is made deformable by the body temperature of a foot in direct contact therewith. When used for a long period whilst keeping such a direct thermal contact, accumulation of heat occasionally cause fluidization of the fitting pad which is thereupon rendered vulnerable to force application. As a consequence, continued application of force during long use of the ski boot forces the fitting pad to lose its correct position leading to the problem that movement of the leg cannot be transmitted to the ski sufficiently. In particular in the case of a gum fitting pad containing paraffin wax its highly crystalline nature requires a great deal of melting energy, thereby rendering deformation relatively difficult.

In the case of the soft foam urethane fitting pad, injection of the reactive solutions requires very careful operation. Even a small misstep in the operation would cause loss of balance in the flow of the material and, as a result, a foot in the fitting pad is held at a biased position. In addition, the state of the fitting pad cannot be amended after hardening. Since soft foam urethane is extremely soft, strong pressure must be applied to the foot in covering by the fitting pad and long use of the fitting pad under such a high pressure tends to cause foot pain.

SUMMARY OF THE INVENTION

It is the object of the present invention to provide a fitting pad for ski boots which causes no fluidization and no pain on the user's foot even during long use and assures easy operation required for application.

In accordance with the basic aspect of the present invention, the fitting pad is made of a copolymer containing vinyl acetate, an acrylic component and ethylene, the content ratio of components other than ethylene is 20% by weight or larger, and the average molecular weight is 30,000 or smaller.

In accordance with the most preferred embodiment of the present invention, the copolymer is a thermoplastic resin having a glass transition point temperature of −15° C. or lower, a Shore A hardness from 90 to 10 in a temperature range form −15° to 40° C. and a melt flow rate of 300 g/10 min or larger, the peak temperature is in a range from 30° to 80° C., the melt terminal temperature is in a range from 40° to 90° C. and the melt thermal energy is 50 cal/g or smaller in a temperature range from 25° C. to the melt terminal temperature, all when measured by heat analysis according to differential scanning calorimetry.

BRIEF DESCRIPTION OF THE DRAWINGS

FIG. 1 is a sectional plan view of one example of the fitting pad in accordance with the present invention, FIG. 2 is a sectional side view of the fitting pad shown in FIG. 1.

DESCRIPTION OF THE PREFERRED EMBODIMENTS

As stated above, the copolymer forming the fitting pad of the present invention contains, as the major component, vinyl acetate, an acrylic component and ethylene. Here, the acrylic component is given in the form of acrylic acid, methacrylic acid or their derivatives such as methylacrylate, methylmethacrylate and ethylacrylate. In addition to such major components, the copolymer may further contain some monomers such as butadiene for better quality.

In the composition of such a copolymer, the content ratio of components other than ethylene should be 20% by weight or larger. When the content ratio falls short of this lower limit, too hard nature of the resultant fitting pad would cause pain on the skier's foot. Further, fluidization of the material at melting would be decelerated whilst requiring great deal of melting energy.

The average molecular weight of the copolymer should be 30,000 or smaller. Any molecular weight over this upper limit would again decelerate fluidization of the material at melting.

Figure 5:
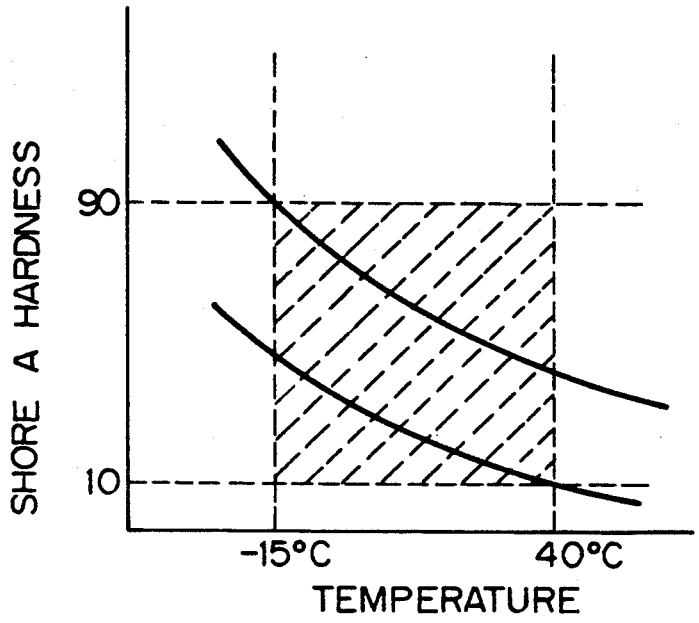
FIG. 5 is a graph for showing the Shore A hardness exhibited by the fitting pad in accordance with the present invention.

More specifically, such a copolymer includes, for example, ACRYFT produced by Sumitomo Chemical as the ethylen-methylmethacrylate copolymer; ACRYFT produced by Sumitomo Chemical as the ethylene-vinyl acetate-methylmethacrylate copolymer containing 3.5% by weight of methylmethacrylate and 27.7% by weight of ethylene-vinyl acetate, and having a relationship between Shore hardness and temperature as shown in FIG. 5 hereof, whereby in particular at the temperature range of from −15° to 40° C. the material has a Shore hardness from 90 to 10; NUC-EEA produced by Nihon Unicar. EVAFLES produced by Mitsui Dupont and REXPOLE produced by Nihon Sekiyu as the ethylene-ethylacrylate copolymers; and POLY-ETH produced by Gulf and Nagase as the ethylen-methyacrylate copolymer.

When necessary, an aqueous plasticizer may be added to the copolymer for adjustment of the physical properties such as the hardness. For the plasticizer is usable a dibasic ester type plasticizer such as dioctylphthalate, a phosphoric ester type plasticizer, a sebacic acid ester type plasticizer, adipic acid ester type plasticizer or a poly ester type plasticizer.

Figure 4:
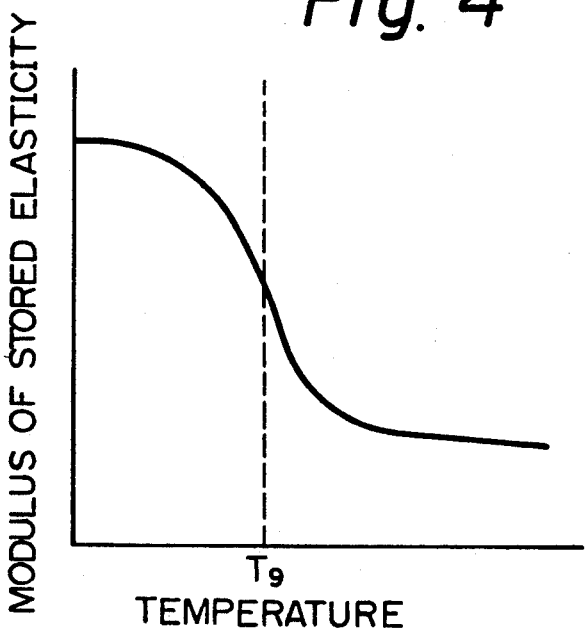
FIG. 4 is a graph for showing the general relationship between the modulus of stored elasticity and the temperature of a copolymer.

Preferably such a copolymer is given in the form of a thermoplastic resin having a glass transition point temperature of −15° C. or lower, a Shore A hardness from 90 to 10 in a temperature range from −15° to 40° C. and a melt flow rate of 300 g/10 min or larger. Thanks to such a relatively low glass transition point temperature, the fitting pad of the present invention exhibits rubber like elastic behavior for comfortable holding of the skier's foot during usage. As clearly seen in FIG. 4, a thermoplastic resin generally shows abrupt rise in modulus of stored elasticity at a temperature beyond its glass transition point temperature Tg. In the case of the fitting pad in accordance with the present invention, its glass transition point temperature does not exceed −15° C. which corresponds the estimated lowest temperature encountered during use of a ski boot. As a consequence it exhibits rubber like elastic nature during usage and hold the foot very comfortably.

The relationship between the Shore A hardness and temperature is shown in FIG. 5. In the temperature range from −15° to 40° C., the curves passes the region defined in accordance with the present invention. The Shore A hardness in this range assures no substantial pain on the foot during usage whilst allowing sufficient transmission of force between the foot and the ski boot.

The relatively high melt flow rate of the copolymer making up the fitting pad of the present invention ensures sufficient fluidization of the material at injection into the ski boot. In particular, it allows gradual reduction in thickness in the peripheral sections of the fitting pad which is essential for comfortable fitness.

Figure 6:
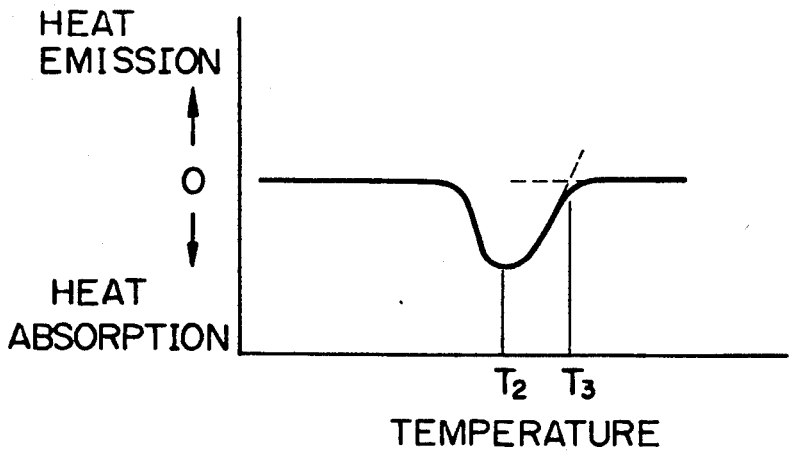
FIG. 6 is a graph for showing general data obtained by the differential scanning calorimetry.

When measured by the heat analysis according to difference indicative scanning calorie measurement scheme, data such as shown in FIG. 6 is obtained, in which $T_2$ indicates the peak temperature and $T_3$ indicates the melt terminal temperature. In the case of the copolymer making up the fitting pad in accordance with the present invention, the peak temperature in a range from 30° to 80° C. and the melt terminal temperature is in a range from 40° to 90° C. Thanks to such temperature characteristic, no accidental deformation of the hard shell of the boot occurs at injection of the material into the boot. Further, since no excessive fluidization of the fitting pad by the body temperature takes place, the fitting pad assures initial good fitness to the skier's foot.

The melt thermal energy of the copolymer used in the present invention is 50 cal/g or smaller in a temperature range from 25° C. to the melt terminal temperature. Such a relatively low melt thermal energy allows quick injection of the material even at a temperature below the heat resisting temperature of the fitting pad. For example, the injection can be completed within 30 minutes.

The copolymer for the fitting pad in accordance with the present invention is easily softened and fluidized by properly heating so as to well fit the shape of the skier's foot. The resulting configuration of the fitting pad is fixed by subsequent cooling. Since the copolymer is not fluidized at a temperature near the possible body temperature of the foot and, as a consequence, no undesirable deformation of the fitting pad occurs during normal usage. By tactful adjustment in amount of the aqueous plasticizer to be optionally added, the hardness and fluidization of the material can be controlled as desired.

EXAMPLES

Samples 1 to 4 of the fitting pad in accordance with the present invention were prepared from copolymers shown in Table 1 each having a construction shown in FIGS. 1 and 2.

The material used for Example 1 has a commercial name "ACRYFT CK 5006" produced by Sumitomo Chemical, the material for Examples 2 to 4 has a commercial name "ACRYFT WK 505" produced also by Sumitomo Chemical. The material used for comparative Sample C1 has a commercial name "WAX 135" produced by Nikko Fine Products and the material used for the comparative Sample C2 has a commercial name "EVAFLEX" produced by Mitsui Dupont.

TABLE 1

| Sample | comonomer | Copolymer comonomer other than ethylene | molecular weight Mn | DOP content phr |
|---|---|---|---|---|
| 1 | ethylene/ vinyl acetate/ methylmeth-acrylate | 30 | 5000 | — |
| 2 | ethylene/ metylmeth-crylate | 28 | 5000 | 0 |
| 3 | ethylene/ metylmeth-crylate | | | 30 |
| 4 | ethylene/ metylmeth-crylate | | | 70 |
| C1 | paraffin-wax | — | — | — |
| C2 | ethylene/ vinyl acetate | 19 | 51000 | — |

FN; DOP = Dioctylphthalate

Figure 3:
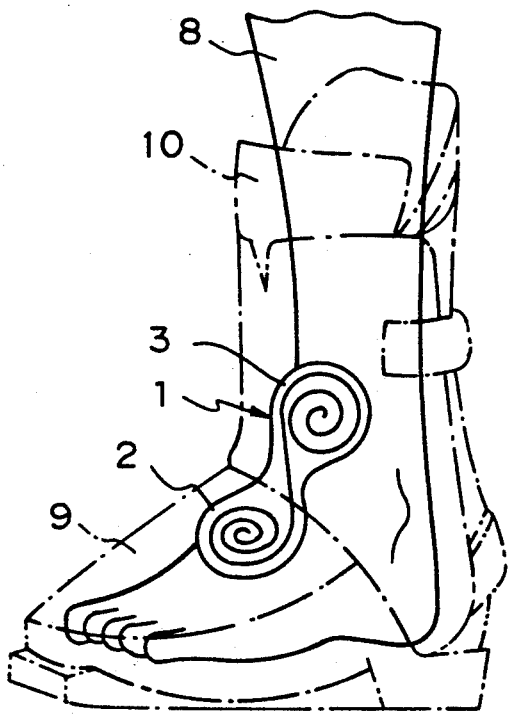
FIG. 3 is a simplified perspective view of the fitting pad in use.

In FIGS. 1 and 2, the fitting pad 1 is made up of a substantially circular instep covering section 2 and a substantially circular shin covering section connected to each other near the peripheries. The fitting pad 1 includes a fitting material 5 loosely accommodated in a bag 4. Several heating wired 6 are embedded in the fitting material 5 in an arrangement electrically connectable to a given external power source 7. As shown in FIG. 3, the fitting pad 1 is inserted into a shell of a ski inner boot 10 with the instep covering section 2 in contact with the instep of the skier's foot and the shin covering section in contact with the shin of the skier's leg.

At preparation, the fitting pad 1 was attached to the inner boot 10 and inserted into the shell 9 of the ski boot. Next, the skier's foot 8 was inserted into the inner boot 10 and the heating wires 6 were connected to the power source 7. The fitting material 5 was molten by 10 min. of galvanization. After disconnection from the power source 7, the skier's foot was removed from inside of the inner boot 10 and the boot was left at the room temperature.

Samples 1 to 4 thus prepared were subjected to field test in a skiing ground. The comparative Samples C1 and C2 were subjected to a similar test. Test data such as shown in Tables 2 and 3 were obtained for the Samples.

TABLE 2

| Sample | Tg | $T_2$ $T_3$ | 25to$T_3$ | melt calorie Cal/g |
|---|---|---|---|---|
| 1 | −21.3 | 43.7 | 73 | 34 |
| 2 | −16 | 62.2 | 83 | 41.8 |
| 3 | −30 | 64.5 | 79.5 | 37.8 |
| 4 | −37 | 60.8 | 78.0 | 33.4 |
| C1 | * | 56.7 | 62.0 | 74.6 |
| C2 | −17.0 | 80.6 | 91 | 55 |

FN;
Tg Glass transition point temperature
$T_2$ Peak temperature
$T_3$ Melt terminal temperature
*No rubber like elasticity

TABLE 3

| Sample | Shore A hardness at 15° C. | Shore A hardness at 40° C. | Melt flow rate g/10 min |
|---|---|---|---|
| 1 | 83 | 42 | 770 |
| 2 | 89 | 68 | 450 |
| 3 | 82 | 51 | 1800 |
| 4 | 68 | 28 | *** |
| C1 | — | ** | ** |
| C2 | 99 | 85 | 2.5 |

FN;
**No stable indication by the meter
***Unmeasurable due to excessive fluidity It is clear from the data in the Tables that the fitting materials of Samples 1 to 4 could be smoothly formed into the fitting pads within short periods. Such smooth processing is deemed to be resulted from their small melting calories. Good fitness was reported by skiers joined the field test of the samples. It is also confirmed that addition of DOP in Samples 3 and 4 in particular enabled quick and smooth processing of the fitting materials. In contrast to this, the fitting materials used for the comparative Samples required slow a difficult processing.

It was also reported by skiers joined in the field test that the fitting pads of the present invention caused substantially no pain on foot even after long use whilst allowing sharp operations in skiing. In the case of Sample C1, the pad exhibited no behaviors as an elastomer and caused innegligible pain on foot. The pad of the comparative Sample C2 was too hard and caused innegligible pain on foot even after short period of use.

It was also confirmed by persons involved in the test that the fitting pads of Samples 1 to 4 were provides with thin peripheral sections resulted from good fluidization of the fitting materials used.

Fitting materials of Samples 1 to 4 were taken out from associated bags and heated up to their peak temperatures. It was observed that the resins experiences deformation on application of external force under heat but resumed their initial gel state after removal of the force.

As a substitute for the heating wires incorporated in the fitting material, they may be incorporated in the construction of a ski boot. Further, heating may be carried out by a proper outside heater separate from the boot.

We claim:

1. A ski boots fitting pad comprising a copolymer including a first polymer unit selected from the group consisting of acrylic monomer units and vinyl acetate monomer units, and a second polymer unit comprising ethylene, wherein said first polymer unit comprises at least about 20 percent by weight of said copolymer, said copolymer having a number average molecular weight of less than about 30,000, a melt flow rate of at least 300 gram/10 min., and a melt thermal energy not greater than about 50 cal/gram in a temperature range from about 25° C. to the melt terminal temperature of said copolymer.

2. A fitting pad as claimed in claim 1 wherein said copolymer has a glass transition temperature of up to about −15° C., a Shore A hardness from 90 to 10 in a temperature range from −15° C. to 40° C.

3. A fitting pad as claimed in claim 1 wherein said copolymer has a peak temperature when measured by differential scanning calorimetry in a range from 30° C. to 80° C.

4. A fitting pad as claim in claim 3 wherein said copolymer has a melt terminal temperature in a range from 40° C. to 90° C.

5. A fitting pad as claimed in claim 1 wherein said acrylic monomer unit is selected from the group consisting of acrylic acid, methacrylic acid, methylacrylate and ethylacrylate.

6. The fitting pad as claimed in claim 1 including an aqueous plasticizer.

7. The fitting pad as claimed in claim 6 wherein said aqueous plasticizer is dioctylphthalate.

8. The fitting pad as claimed in claim 6 wherein said aqueous plasticizer is selected from the group consisting of dibasic ester plasticizers, phosphoric ester plasticizers, and polyester plasticizers.

9. The fitting pad as claimed in claim 1 wherein said first polymer unit comprises methyl methacrylate.

10. The fitting pad as claimed in claim 1 including bag means defining a storage compartment, said copolymer being disposed within said storage compartment.

11. A ski boot fitting pad having an outer shell and an inner shell, said inner shell adapted for the receipt of a foot having an instep portion and a shin portion, said fitting pad including bag means defining a storage compartment, and a copolymer contained within said storage compartment, said copolymer including a first polymer unit selected from the group consisting of acrylic monomer units and vinyl acetate monomer units, and a second polymer unit comprising ethylene, wherein said first polymer unit comprises at least about 20 percent by weight of said copolymer and said copolymer having a number average molecular weight of less than about 30,000, a glass transition temperature of up to about −15° C., a Shore A hardness from about 90 to 10 in a temperature range from about −15° C. to 40° C., a melt flow rate of at least 300 grams/10 min., and a melt thermal energy not greater than about 50 cal/gram in a temperature range from about 25° C. to the melt terminal temperature of said copolymer, said fitting pad being disposable within said inner shell and having a first portion for contacting said shin portion of said foot and a second portion for contacting said instep portion of said foot.

12. The fitting pad as claimed in claim 11 wherein the fitting pad includes heating means embedded in said copolymer and including means for connecting said heating means to an external power source.

13. A fitting pad as claimed in claim 11 wherein said copolymer has a peak temperature when measured by differential scanning calorimetry in the range of from about 30° C. to 80° C.

14. A fitting pad as claimed in claim 13 wherein said copolymer has melt terminal temperature in the range of from about 40° C. to 90° C.

* * * * *

UNITED STATES PATENT AND TRADEMARK OFFICE

CERTIFICATE OF CORRECTION

PATENT NO. : 5,149,588

DATED : September 22, 1992

INVENTOR(S) : Toshiharu Fukushima and Takashi Okada

It is certified that error appears in the above-identified patent and that said Letters Patent is hereby corrected as shown below:

Column 1, line 38, "cause" should read --causes--.
Column 1, line 45, after "wax" insert --,--.
Column 2, line 50, after "requiring" insert --a--.
Column 2, line 57, "ethylen-methylmethacrylate" should read --ethylene-methylmethacrylate--.
Column 3, lines 1-2, "ethylen-methylmethacrylate" should read --ethylene-methylmethacrylate--.
Column 3, line 27, "hold" should read --holds--.
Column 3, line 49, after "such" insert --a--.
Column 4, TABLE 1, under column entitled "comonomer" in each instance "crylate" should read --acrylate--.
Column 5, line 34, before "joined" insert --who--.
Column 5, line 48, "provides" should read --provided--.
Column 5, line 53, "experiences" should read --experience--.
Column 5, line 63, "boots" should read --boot--.
Column 6, line 3, "gram" should read --grams--.
Column 6, line 15, "claim" (first occurrence) should read --claimed--.

Signed and Sealed this

Nineteenth Day of October, 1993

*Attest:*

Bruce Lehman

BRUCE LEHMAN

*Attesting Officer*

*Commissioner of Patents and Trademarks*